US010311788B2

(12) United States Patent
Lim et al.

(10) Patent No.: US 10,311,788 B2
(45) Date of Patent: Jun. 4, 2019

(54) ORGANIC LIGHT-EMITTING DISPLAY AND DRIVING METHOD THEREOF

(71) Applicant: LG DISPLAY CO., LTD., Seoul (KR)

(72) Inventors: Myunggi Lim, Ansan-si (KR); Kyoungdon Woo, Paju-si (KR); Jaeyoon Bae, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 15/816,553

(22) Filed: Nov. 17, 2017

(65) Prior Publication Data

US 2018/0151121 A1 May 31, 2018

(30) Foreign Application Priority Data

Nov. 29, 2016 (KR) ..... 10-2016-0160638

(51) Int. Cl.
*G09G 3/36* (2006.01)
*G09G 3/3233* (2016.01)

(52) U.S. Cl.
CPC ... *G09G 3/3233* (2013.01); *G09G 2300/0819* (2013.01); *G09G 2300/0861* (2013.01); *G09G 2310/0251* (2013.01); *G09G 2310/0262* (2013.01); *G09G 2320/0247* (2013.01); *G09G 2320/0295* (2013.01)

(58) Field of Classification Search
CPC .. G09G 3/30; G09G 3/36; G09G 5/00; G09G 5/10; G06F 3/038; G06K 9/00
See application file for complete search history.

(56) References Cited

U.S. PATENT DOCUMENTS 9,761,177 B2 * 9/2017 Mizukoshi ..... G09G 3/3266
2009/0167648 A1 * 7/2009 Jeon ..... G09G 3/3233 345/76
2012/0038608 A1 2/2012 Seo et al.
2012/0127150 A1 * 5/2012 Kim ..... G09G 3/3233 345/212
2015/0161940 A1 * 6/2015 Woo ..... G09G 3/003 345/58
2016/0225318 A1 8/2016 Choi
2017/0011684 A1 1/2017 Nakatani

FOREIGN PATENT DOCUMENTS

WO WO 2015/116601 A1 8/2015

* cited by examiner

*Primary Examiner* — Pegeman Karimi
(74) *Attorney, Agent, or Firm* — Birch, Stewart, Kolasch & Birch, LLP

(57) ABSTRACT

An organic light-emitting display includes a driving transistor that drives an organic light-emitting diode, a first transistor connected between a data line supplying a data voltage and a gate electrode of the driving transistor, a second transistor connected between a reference voltage input line and a source electrode of the driving transistor, and a third transistor that directly charges the gate electrode of the driving transistor with a reference voltage supplied from the reference voltage input line, in response to a black data control signal, wherein the third transistor directly receives the reference voltage by being turned on for a certain period of time after the gate electrode of the driving transistor is programmed with the data voltage in one frame before receiving a data voltage in the next frame.

12 Claims, 7 Drawing Sheets

ORGANIC LIGHT-EMITTING DISPLAY AND DRIVING METHOD THEREOF

This application claims the priority benefit of Korean Patent Application No. 10-2016-0160638 filed on Nov. 29, 2016, which is hereby incorporated herein by reference for all purposes as if fully set forth herein.

BACKGROUND

Field of the Invention

The present invention relates to an active-matrix organic light-emitting display and a driving method thereof.

Discussion of the Related Art

Flat-panel displays (FPDs) are widely used for monitors for desktop computers, portable computers such as laptops and personal digital assistants (PDAs), mobile phones, and so on, because they offer advantages in terms of slimness and light-weightness. Such flat-panel displays include liquid-crystal displays (LCDs), plasma display panels (PDPs), field emission displays (FEDs), and organic light-emitting diode (OLED) displays.

An OLED, which is a self-luminous device, comprises an anode and a cathode, and an organic compound layer formed between the anode and cathode. The organic compound layer comprises a hole transport layer HTL, an emission layer EML, and an electron transport layer ETL. When an operating voltage is applied to the anode and the cathode, a hole passing through the hole transport layer HTL and an electron passing through the electron transport layer ETL move to the emission layer EML, forming an exciton. As a result, the emission layer EML generates visible light.

An active matrix organic-light emitting display comprises a plurality of OLEDs each emitting light itself, and is used in various applications due to their advantages of fast response time, high luminous efficiency, high luminance, and wide viewing angle.

In the organic light-emitting display, pixels each comprising an OLED are arranged in a matrix, and the luminance of the pixels is adjusted depending on the gray levels of their video data. Each pixel further comprises a driving transistor that controls drive current flowing through the OLED depending on a gate-source voltage, and at least one switching transistor that programs the gate-source voltage of the driving transistor. The drive current is determined by the gate-source voltage of the driving transistor relative to a data voltage and the threshold voltage of the driving transistor, and the luminance of each pixel is proportional to the amount of drive current flowing through the OLED.

Meanwhile, a technology for inserting a black image was proposed to reduce the motion picture response time (MPRT) of an organic light-emitting display. That is, this technology is to eliminate an image of a previous frame by displaying a black image in between image frames. However, the general techniques of displaying a black image require twice as high video frame rates, which creates a problem of making the data charging time shorter.

SUMMARY OF THE INVENTION

An exemplary embodiment of the present invention provides an organic light-emitting display comprising a driving transistor that drives an organic light-emitting diode; a first transistor connected between a data line supplying a data voltage and a gate electrode of the driving transistor; a second transistor connected between a reference voltage input line and a source electrode of the driving transistor; and a third transistor that directly charges the gate electrode of the driving transistor with a reference voltage supplied from the reference voltage input line, in response to a black data control signal, wherein the third transistor directly receives the reference voltage by being turned on for a certain period of time after the gate electrode of the driving transistor is programmed with the data voltage in one frame before receiving a data voltage in the next frame.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
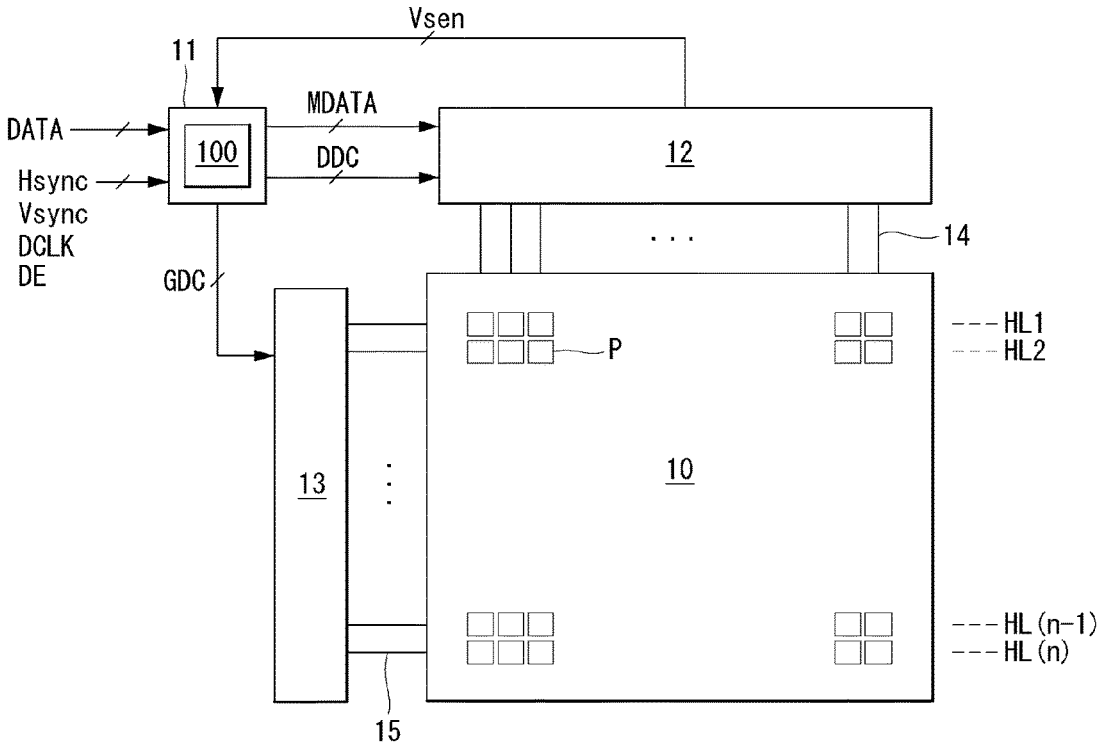
FIG. 1 is a view showing an organic light-emitting display according to an exemplary embodiment of the present invention.

Advantages and features of the present disclosure and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims.

Hereinafter, exemplary embodiments of the present invention will be described in detail with reference to the accompanying drawings. Throughout the specification, the same reference numerals indicate substantially the same components. In describing the present invention, when it is deemed that a detailed description of known functions or configurations may unnecessarily obscure the subject matter of the present invention, the detailed description will be omitted.

Although the embodiments of the present invention disclose transistors of a pixel that are all implemented as P-type, the technical idea of the present invention is not limited thereto and may be applicable to N-type transistors.

FIG. 1 is a view showing an organic light-emitting display according to an exemplary embodiment of the present invention. All the components of the organic light-emitting display according to all embodiments of the present invention are operatively coupled and configured.

Referring to FIG. 1, the organic light-emitting display according to the present invention comprises a display panel 10 with a plurality of pixels P, a timing controller 11, a data driver 12, and a gate driver 13.

The pixels P are arranged in a matrix on the display panel 10. Each pixel P is connected to a data line region 14 and a gate line region 15. The data line region 14 comprises data lines 14A and reference voltage lines 14B (see FIG. 2). The gate line region 15 comprises a plurality of gate lines.

A semiconductor layer of transistors of each pixel P may be an oxide semiconductor layer, amorphous silicon (a-Si), polycrystalline silicon (poly-Si), or organic semiconductor.

The timing controller 11 generates a data control signal DDC for controlling the operation timing of the data driver 12 and a gate control signal GDC for controlling the operation timing of the gate driver 13, based on timing signals such as a vertical synchronization signal Vsync, a horizontal synchronization signal Hsync, a dot clock signal DCLK, and a data enable signal DE. Also, the timing controller 11 generates digital compensation data MDATA for compensating for changes in the threshold voltage and mobility of a driving transistor by modulating input digital video data DATA with reference to a digital sensing voltage value supplied from the data driver 12, and then supplies the digital compensation data MDATA to the data driver 12.

In a sensing operation, the data driver 12 supplies the pixels P with a sensing data voltage synchronized with a first scan signal for sensing, based on a data control signal DDC from the timing controller 11, and converts sensing voltages input from the display panel 10 through the reference voltage lines (14B of FIG. 2) into digital values and supplies them to the timing controller 11. In an image display operation, the data driver 12 converts digital compensation data MDATA input from the timing controller 11 into a data voltage for image display, and then synchronizes the data voltage for image display with a first scan signal for image display and supplies it to the data lines (14A of FIG. 2).

The gate driver 13 generates a gate pulse based on a gate control signal GDC from the timing controller 11. The gate pulse comprises a scan signal, a sense signal, and a black data control signal. The black data control signal maintains gate-off voltage in the sensing operation. The timings of the scan signal and sense signal may vary for sensing and display operations. The gate driver 13 may be provided directly on the display panel 10 by GIP (gate-driver in panel) technology.

Figure 2:
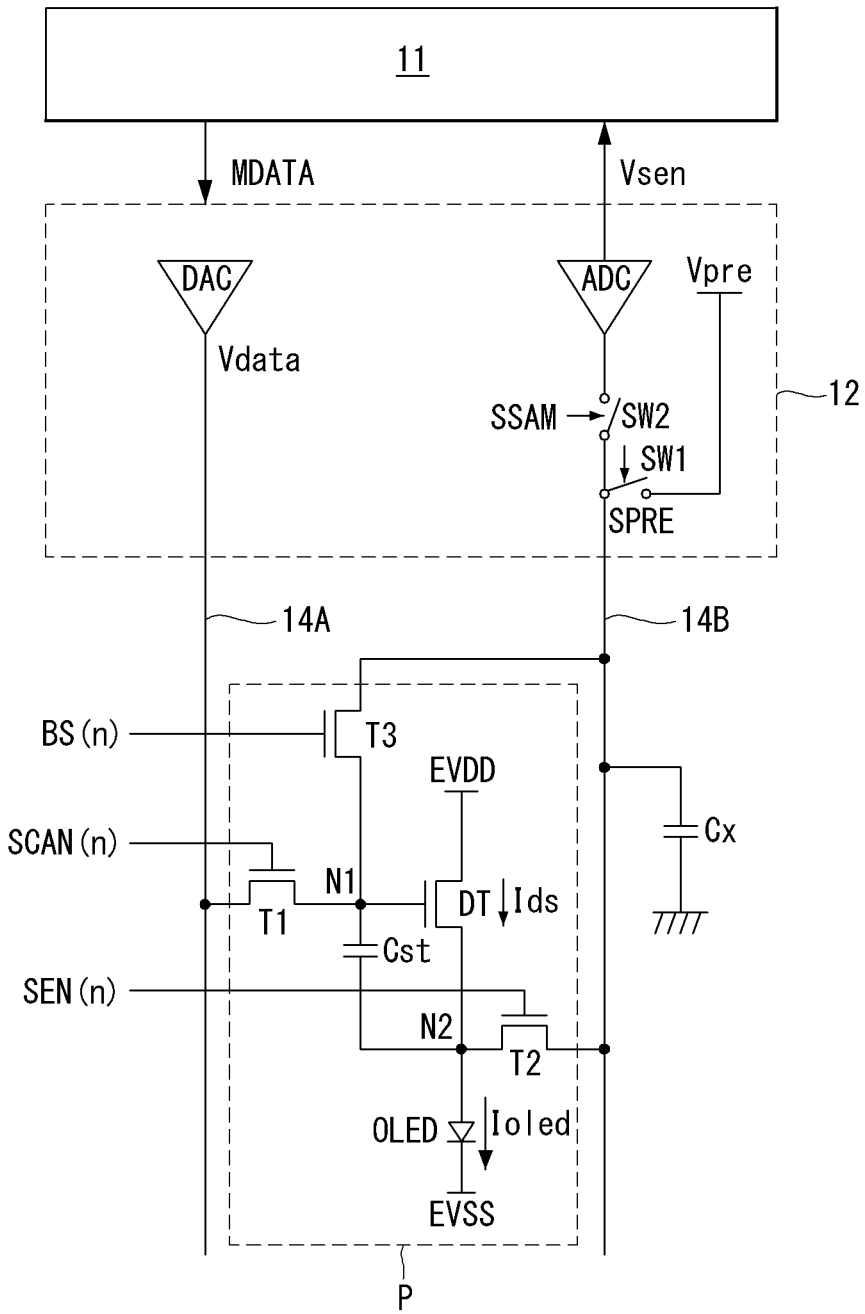
FIG. 2 is an equivalent circuit diagram of a pixel of an organic light-emitting display according to a first exemplary embodiment of the present invention.

FIG. 2 is a view showing an example of a pixel structure and a data driver according to a first exemplary embodiment of the present invention. FIG. 2 depicts a first pixel P arranged on an nth pixel line HLn.

Referring to FIGS. 1 and 2, the pixels arranged on the nth pixel line are connected to the data driver 12 through a first data line 14A and a first reference voltage line 14B. A sensing capacitor Cx for storing the source voltage of a second node N2 as a sensing voltage Vsen may be formed on the reference voltage line 14B.

The data driver 12 comprises a digital-analog converter DAC, an analog-digital converter ADC, a reset switch SW1, and a sampling switch SW2.

In a sensing operation, the digital-analog converter DAC may generate a data voltage Vdata for sensing and output it to the data line 14A, under control of the timing controller 11. In an image display operation, the DAC may convert digital compensation data into a data voltage Vdata for image display and output it to the data line 14A, under control of the timing controller 11.

The reset switch SW1 switches the current flow between an input terminal of reset voltage Vpre and the reference voltage line 14B, in response to a reset control signal SPRE. In the sensing operation, the sampling switch SW2 switches the current flow between the reference voltage line 14B and the analog-digital converter ADC, in response to a sampling control signal SSAM, and supplies the ADC with a sensing voltage Vsen, which is the source voltage of the driving transistor DT stored in the sensing capacitor Cx on the reference voltage line 14B for a certain period of time. In the display operation, the sampling switch SW2 continues to remain turned off in response to a sampling control signal SSAM.

Each pixel P comprises an organic light-emitting diode OLED, a driving transistor DT, first to third transistors T1 to T3, and a capacitor Cst.

The organic light-emitting diode OLED emits light by a drive current supplied from the driving transistor DT. Multiple layers of organic compounds are formed between an anode and cathode of the organic light-emitting diode OLED. The organic compound layers may comprise at least one hole transfer layer, at least an electron transfer layer, and an emission layer EML. The hole transfer layer is a layer that injects or transfers a hole into the emission layer—for example, a hole injection layer HIL, a hole transport layer HTL, and an electron blocking layer EBL. The electron transfer layer is a layer that injects or transfers an electron into the emission layer—for example, an electron transport layer ETL, an electron injection layer EIL, and a hole blocking layer HBL. The anode of the organic light-emitting diode OLED is connected to the second node N2, and the cathode of the organic light-emitting diode OLED is connected to an input terminal of low-potential driving voltage EVSS.

The driving transistor DT controls the drive current Ioled flowing through the organic light-emitting diode OLED according to a gate-source voltage Vgs. The driving transistor DT comprises a gate electrode connected to a first node N1, a drain electrode connected to an input terminal of high-potential driving voltage EVDD, and a source electrode connected to the second node N2.

The storage capacitor Cst is connected between the first node N1 and the second node N2.

The first transistor T1 comprises a gate electrode connected to an input terminal that supplies a scan signal SCAN, a drain electrode connected to the data line 14A, and a source electrode connected to the first node N1.

The second transistor T2 comprises a gate electrode connected to an input terminal that supplies a sense signal SEN, a drain electrode connected to the second node N2, and a source electrode connected to the reference voltage line 14B.

The third transistor T3 comprises a gate electrode connected to an input terminal that supplies a black data control signal BS, a drain electrode connected to the reference voltage line 14B, and a source electrode connected to the first node N1.

A reference voltage Vref applied through the reference voltage line 14B may be well below an operating range of the organic light-emitting diode OLED so as to keep the organic light-emitting diode OLED from emitting light during a programming period. For example, the reference voltage Vref may be set to be equal to or lower than the low-potential driving voltage EVSS.

Figure 3:
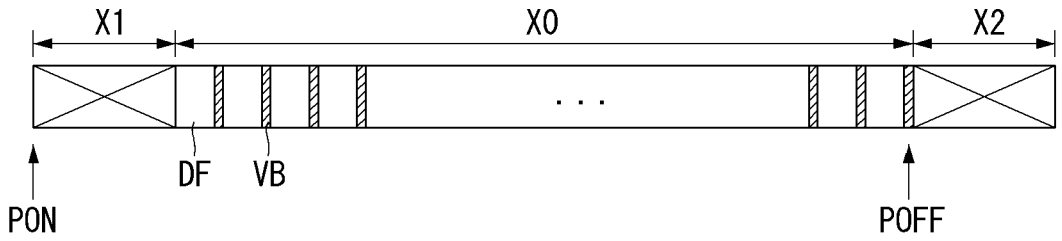
FIG. 3 is a view showing an example of display and non-display periods for the organic light-emitting display according to the present invention.

FIG. 3 is a view showing an example of a driving period for the organic light-emitting display according to the present invention.

Referring to FIG. 3, the driving period for the organic light-emitting display according to the present invention comprises first and second non-display periods X1 and X2 and an image display period X0.

The first non-display period X1 may be defined as the time from power on PON until several tens or hundreds of frames later, and the second non-display period X2 may be defined as the time from power off POFF until several tens or hundreds of frames later.

The image display period X0 comprises display intervals DF during which a data voltage is written to the pixels P and vertical blanking intervals VB during which no video data is written.

A compensation period is positioned in a part other than the display intervals DF. The compensation period may belong to the first and second non-display periods X1 and X2 or to the vertical blanking intervals VB. During the compensation period, the data driver 12 generates a compensation data voltage by sensing the threshold voltage Vth of the driving transistor DT and calculating the variation in threshold voltage Vth based on the sampled threshold voltage Vth.

The compensation period comprises a programming period Tpg, a sensing period Tsen, and a sampling period Tsam.

Figure 4:
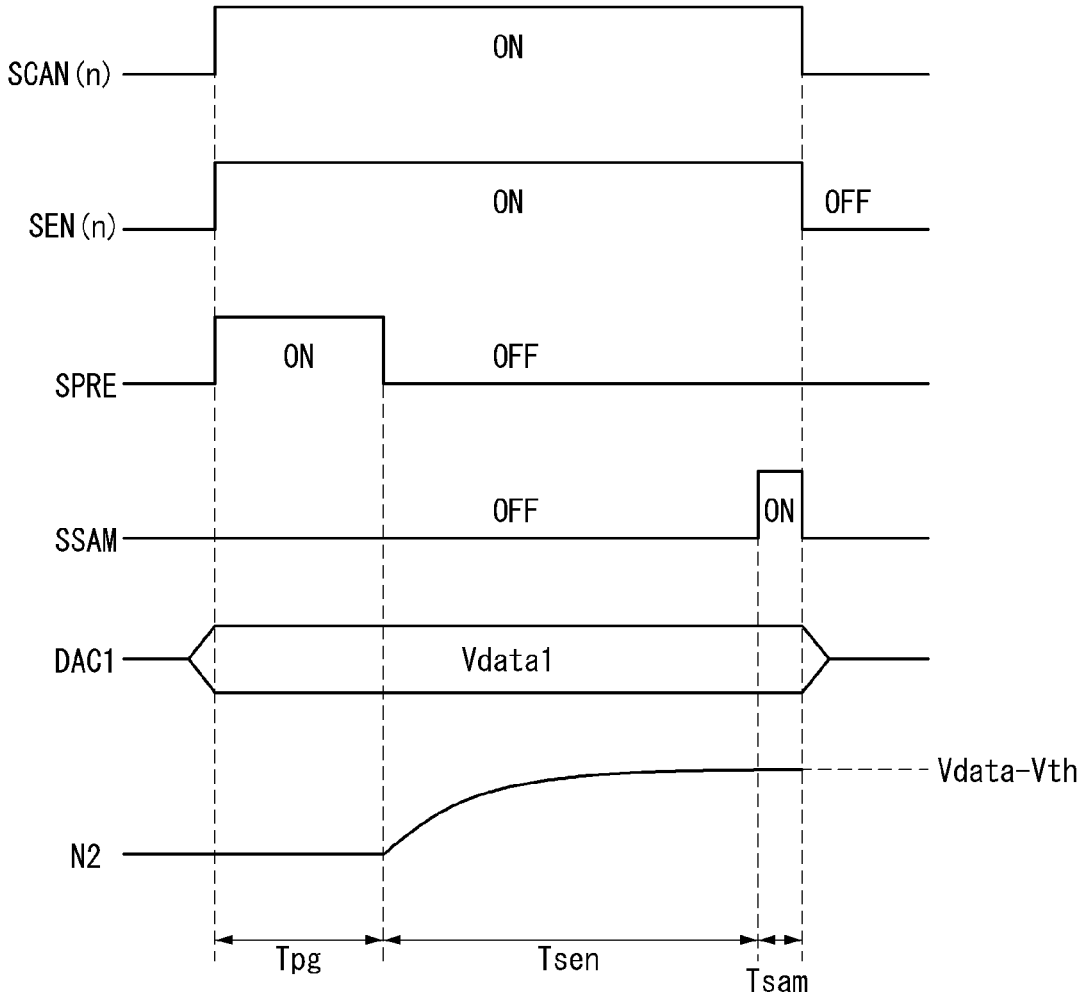
FIG. 4 is a view showing an example of driving signals in a sensing period for the organic light-emitting display according to the present invention.

FIG. 4 is a view showing an example of the timings of driving signals in a compensation period according to an embodiment of the present invention. An operation of the compensation period will be described below with reference to FIGS. 2 and 4.

In the programming period Tpg, the gate-source voltage of the driving transistor DT is set to turn on the driving transistor DT. To this end, a scan signal SCAN, a sense signal SEN, and a reset control signal SPRE are input at gate-on level, and a sampling control signal SSAM is input at gate-off level. Accordingly, the first transistor T1 is turned on to supply the first node N1 with a data voltage Vdata for sensing that is output from the digital-analog converter DAC, and the reset switch SW1 and the second transistor T2 are turned on to supply a reference voltage Vref to the second node N2. In this case, the sampling switch SW2 is in the off state.

In the sensing period Tsen, the source voltage of the driving transistor DT rises due to the current Ids flowing through the driving transistor DT, and is detected as a first sensing voltage Vsen1 when it is saturated. In the sensing period Tsen, the gate-source voltage of the driving transistor DT should be kept constant for accurate sensing. To this end, scan signal SCAN for sensing and a sense signal SEN for sensing is input at gate-on level, and the reset control signal SPRE and the sampling control signal SSAM are input at gate-off level. In the sensing period Tsen, the voltage at the second node N2 increases due to the current Ids flowing through the driving transistor DT, and the voltage at the first node N1 increases with the increasing voltage at the second node N2.

In the sampling period Tsam, the source voltage of the driving transistor DT stored in the sensing capacitor Cx for a certain period of time is supplied as the first sensing voltage Vsen1 to the ADC. To this end, sense signal SEN and the sampling control signal SSAM are input at gate-on level, and the reset control signal SPRE is input at gate-off level.

Figure 5:
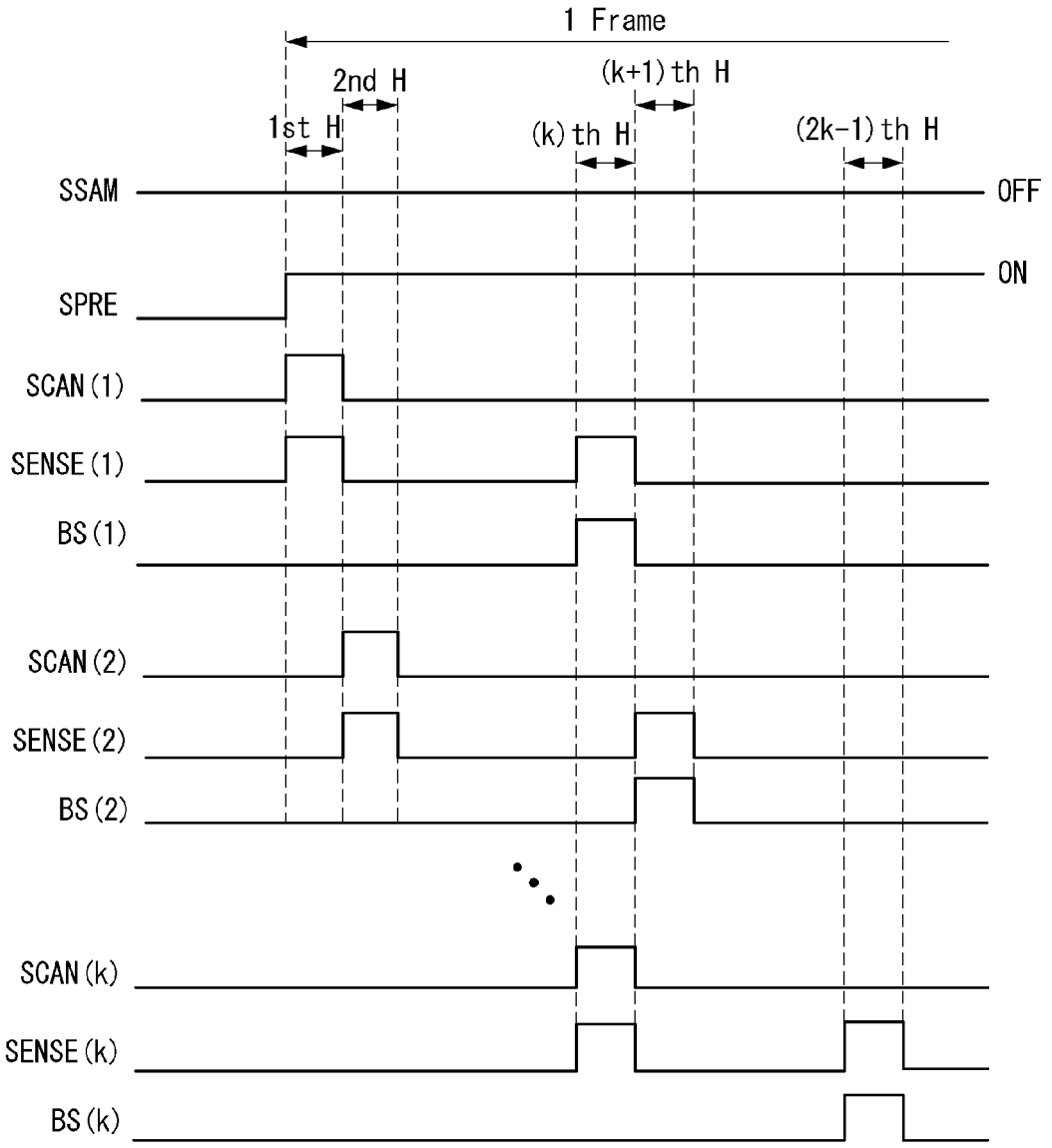
FIG. 5 is a view showing an example of the timings of driving signals in a display interval of the organic light-emitting display according to the first exemplary embodiment.

FIG. 5 is a view showing an example of the timings of gate signals for display operation according to the first exemplary embodiment of the present invention depicted in FIG. 2.

Referring to FIGS. 2 and 5, an operation for a display interval according to the first exemplary embodiment will be described below.

During the display interval DF, the reset control signal SPRE is kept at gate-on voltage, and the sampling control signal SSAM is kept at gate-off voltage. As a result, the reference voltage line 14B supplies the reference voltage Vref to the second node N2.

In this example, 1 frame comprises the period of time from a first horizontal period 1st H in which data is written to a first pixel line HL1 to an nth horizontal period n-th H in which data is written to an nth pixel line HLn. That is, within 1 frame, the pixels P arranged on the first pixel line HL1 to nth pixel line HLn are sequentially programmed.

The driving period for each pixel line HL comprises a programming period, a light-emission period, and a black data display period.

During the programming period, the gate-source voltage of the driving transistor DT of each pixel P is programmed to a voltage value that reflects a data voltage. During the light-emission period, the driving transistor DT of each pixel P generates a drive current that is proportional to the programmed voltage value, and the organic light-emitting diode OLED emits light by this drive current. The black data display period Tbdi is a phase in which the gate electrode and source electrode of the driving transistor DT are reset to stop the organic light-emitting diode OLED from emitting light. The black data display period Tbdi is performed for a certain period of time after the organic light-emitting diode OLED emits light, and the start time of the black data display period Tbdi may be determined by a black data controller 100 to be described later.

During the first horizontal period 1st H, the pixels P arranged on the first pixel line HL1 receive a first scan signal SCAN(1) and a first sense signal SEN(1). As a result, the first node N1 of each of the pixels P arranged on the first pixel line HL1 is charged with a data voltage from the data line 14A, and the second node N2 is charged with the reference voltage Vref. That is, during the first horizontal period 1st H, the gate-source voltage Vgs of the driving transistor of each of the pixels P arranged on the first pixel line HL1 is programmed to a desired voltage level that reflects the data voltage.

After completion of the first horizontal period 1st H, the first scan signal SCAN(1) and the first sense signal SEN(1) are inverted to gate-off voltage, and the first node N1 and second node N2 of each of the pixels P arranged on the first pixel line HL1 go to a floating state. Accordingly, the driving transistor DT of each of the pixels P arranged on the first pixel line HL1 generates a drive current Ids in proportion to the programmed voltage level and applies it to the organic light-emitting diode OLED. After the end of the first horizontal period 1st H, the organic light-emitting diode OLED emits light at a brightness corresponding to the drive current Ids to represent a gray level.

During the second horizontal period 2nd H, the gate-source voltage of the driving transistor DT of each of the pixels P arranged on the second pixel line HL2 is programmed in response to a second scan signal SCAN(2) and a second sense signal SEN(2). Likewise, after completion of the second horizontal period 2nd H, the pixels P arranged on the second pixel line HL2 emit light in response to the programmed voltage.

During a kth horizontal period (k)th H, the gate-source voltage of the driving transistor DT of each of the pixels P arranged on the kth pixel line is programmed in response to a kth scan signal SCAN(k) and a kth sense signal SEN(k).

During the kth horizontal period (k)th H, the first sense signal SEN(1) and a first black data control signal BS(1) are inverted to gate-on voltage. As a result, the first and second nodes N1 and N2 of each of the pixels P arranged on the first pixel line HL1 are charged with the reference voltage Vref. Accordingly, after the kth horizontal period (k)th H, the driving transistor DT of each of the pixels P arranged on the first pixel line HL1 generates no drive current, and the organic light-emitting diode OLED is turned off. The organic light-emitting diode OLED of each of the pixels P arranged on the first pixel line HL1 remains turned off until the first horizontal period 1st H of the next frame. That is, the black data display period for the pixels P arranged on the first pixel line HL1 continues from the kth horizontal period (k)th H until the first horizontal period 1st H of the next frame.

Likewise, during a (k+1)th horizontal period (k+1)th H, the pixels P arranged on a (k+1)th pixel line are programmed, and the pixels P arranged on the second pixel line HL2 are charged with black data and thereby stop emitting light.

As described above, the organic light-emitting display according to the present invention may improve motion picture response time by using a black data display period. Particularly, the organic light-emitting display according to the present invention may display black data without changing driving frequency. That is, it is possible to improve motion picture response time by inserting black data without reducing the length of a programming period.

Moreover, the black data display period according to the present invention may vary in real time.

Figure 6:
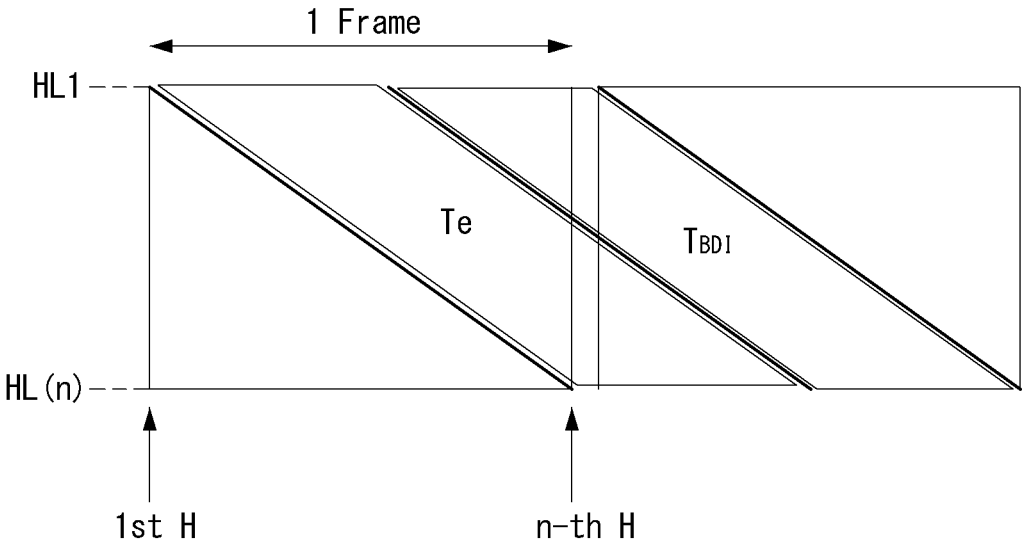
FIG. 6 is a view showing an example of a light-emission period and black data display period for each pixel line on a display panel according to an embodiment of the present invention.
Figure 7:
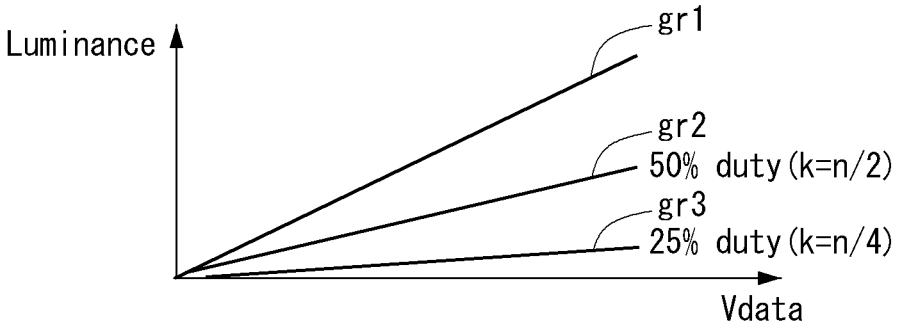
FIG. 7 is a view showing an example of a variation of luminance with black data display period according to an embodiment of the present invention.

FIG. 6 is a view showing an example of a light-emission period and black data display period for each pixel line on a display panel according to an embodiment of the present invention. FIG. 7 is a view showing an example of the relationship between the black data display period and luminance according to an embodiment of the present invention.

Referring to FIGS. 6 and 7, a black data display period Tbdi for each pixel line starts after a certain period of time from the start of a programming period.

A duty cycle, which is defined as the ratio of a light-emission period to 1 frame, is proportional to k. Since the luminance of each pixel P during 1 frame is proportional to the light-emission period, the value of k determines the luminance of each pixel P.

A first line gr1 on the graph of FIG. 7 shows the luminance relative to data voltage Vdata when there is no black data display period Tbdi. A second line gr2 shows the luminance relative to data voltage Vdata when the percentage of a light-emission period Te in one frame is 50% (k=n/2). A third line gr3 shows the luminance relative to data voltage Vdata when the percentage of the light-emission period Te in one frame is 25% (k=n/4).

The black data controller 100 controls the black data display period Tbdi using the relationship between the black data display period Tbdi and luminance shown in FIG. 7. Particularly, the black data controller 100 controls the black data display period Tbdi by controlling the timings of scan signals SCAN and black data control signals BS, in order to improve the luminance characteristics of a low grayscale region.

[Table 1] below shows an example in which the black data controller 100 sets a duty cycle.

TABLE 1

| Average value of video data | Duty cycle |
|---|---|
| DATA_avg ≥ DATA_ref | 50% |
| DATA_avg < DATA_ref | 25% |

Referring to [Table 1], an operation of the black data controller 100 will be described below.

The black data controller 100 receives video data DATA for each pixel line, and calculates the average video data DATA_avg for each pixel line. For example, for m pixels P (m is a natural number) arranged on each pixel line HL, the black data controller 100 calculates the average value of m video data sets DATA. The black data controller 100 compares the average video data DATA_avg with a preset threshold value DATA_ref. If the average video data DATA_avg is at or above the threshold value DATA_ref, the black data controller 100 sets the duty cycle to 50%. If the average video data DATA_avg is below the threshold value DATA_ref, the black data controller 100 sets the duty cycle to 25%. That is, the black data controller 100 sets the duty cycle to a low percentage when the average video data DATA_avg is low, so as to decrease the luminance of the pixels P. The black data controller 100 may set the duty cycle by varying the value of "k" shown in FIGS. 5 and 7. That is, the black data controller 100 controls the output timing of a black data control signal BS and the timing of a sense signal SEN synchronized with the black data control signal BS. The duty cycle set by the black data controller 100 is not limited to the examples given in [Table 1]. The threshold value DATA_ref is a reference luminance for making low gray levels distinctive.

In the organic light-emitting display, when the black data display period Tbdi is inserted, the overall luminance of the pixels P decreases. Due to this, the luminance differences in low grayscale display areas decrease depending on video data. The black data controller 100 according to the present invention may decrease luminance by reducing the light-emission period Te of pixels P representing low gray levels, thereby providing a highlighted low grayscale representation.

Figure 8:
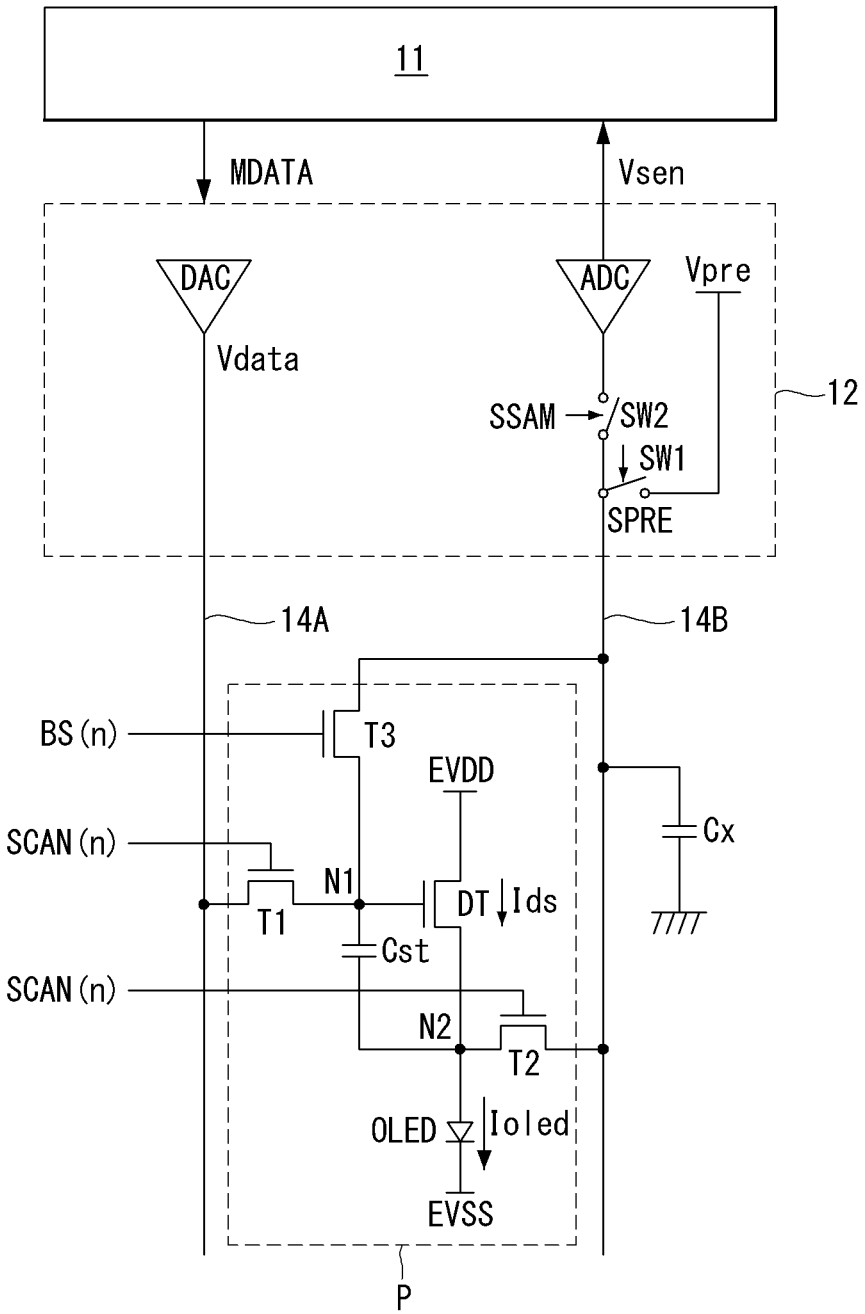
FIG. 8 is an equivalent circuit diagram of a pixel of an organic light-emitting display according to a second exemplary embodiment of the present invention.
Figure 9:
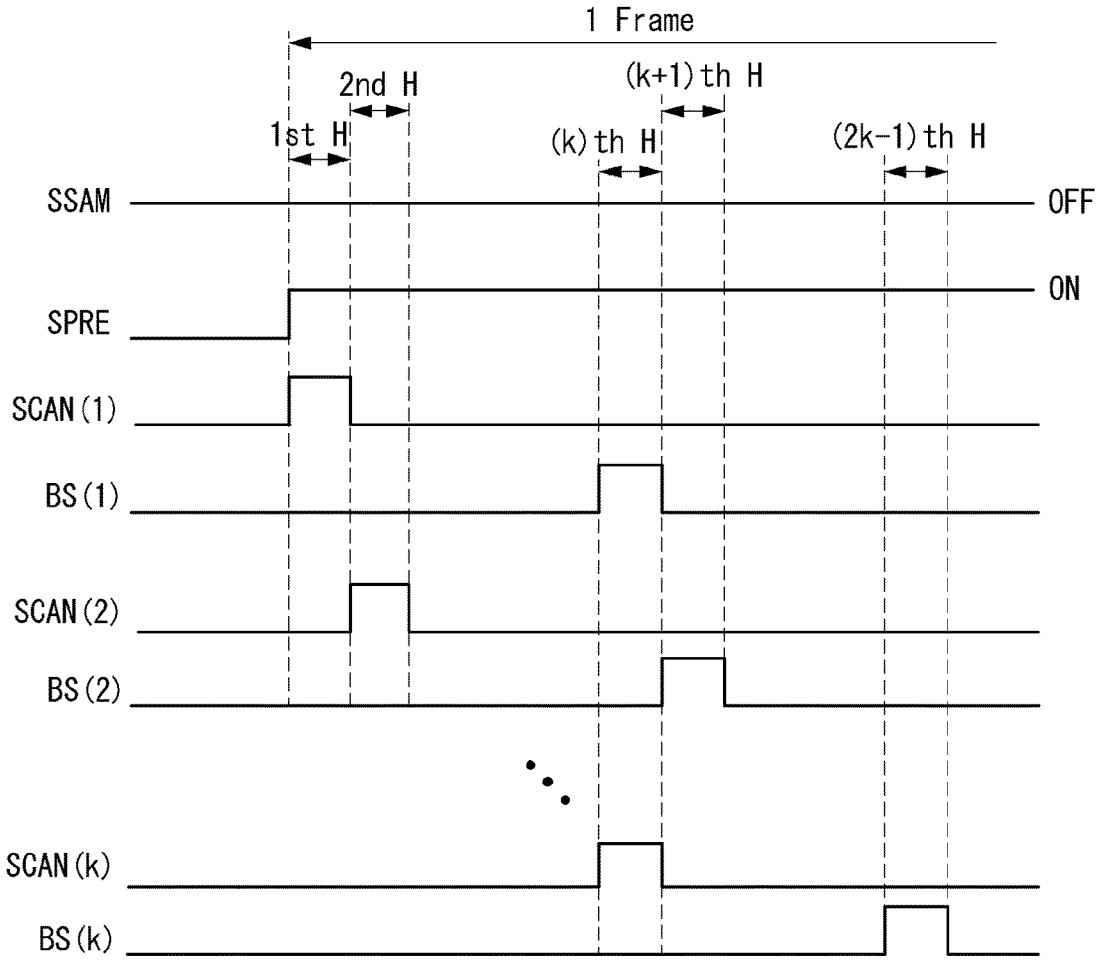
FIG. 9 is a view showing the timings of driving signals in a display interval for an organic light-emitting display according to the second exemplary embodiment.

FIG. 8 is a view showing a pixel array of an organic light-emitting display according to a second exemplary embodiment. FIG. 9 is a view showing driving signals for the pixel array of FIG. 8. Regarding the components in FIGS. 8 and 9, a detailed description will be omitted or brief if they are substantially the same as those in the foregoing exemplary embodiments.

Referring to FIGS. 8 and 9, each pixel according to the second exemplary embodiment comprises a first transistor T1 connected to a first node N1 and a second transistor T2 connected to a second node N2. The first transistor T1 comprises a gate electrode connected to an input terminal that supplies a scan signal SCAN, a drain electrode connected to a data line 14A, and a source electrode connected to the first node N1. The second transistor T2 comprises a gate electrode connected to the input terminal that supplies a scan signal SCAN, a drain electrode connected to the second node N2, and a source electrode connected to a reference voltage line 14B. That is, the first and second transistors T1 and T2 are all turned on in response to a scan signal SCAN.

Like in the first exemplary embodiment, an operation of the organic light-emitting display according to the second exemplary embodiment comprises a programming period, a light-emission period, and a black data display period. The programming period, light-emission period, and black data display period operate in the same way as the first exemplary embodiment, except that the first transistor T1 and the second transistor T2 are all controlled by scan signals SCAN. Since the timings at which the first to third transistors are turn-on and turn-off are substantially the same as in the first exemplary embodiment, the pixels P work in the same way in the first and second exemplary embodiments.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light-emitting display comprising:

pixels arranged on a first pixel line to an nth pixel line, where n is a natural number, wherein each of the pixels includes:

a driving transistor that drives an organic light-emitting diode;

a first transistor connected between a data line supplying a data voltage and a gate electrode of the driving transistor, and turned on according to a scan signal;

a second transistor connected between a reference voltage input line and a source electrode of the driving transistor; and a third transistor that directly charges the gate electrode of the driving transistor with a reference voltage supplied from the reference voltage input line, in response to a black data control signal, wherein the black data control signal is sequentially applied to the first pixel line to the nth pixel lines later than the scan signal, and wherein an interval between the scan signal and the black data control signal is the same in all pixel lines among the first pixel line to the nth pixel line.

2. The organic light-emitting display of claim 1, wherein the source electrode of the driving transistor is connected to an anode of the organic light-emitting diode, and the reference voltage supplied from the reference voltage input line is reset to keep the organic light-emitting diode turned off.

3. The organic light-emitting display of claim 2, wherein the first transistor of each pixel on each pixel line is turned on in response to the scan signal during a programming period to charge the gate electrode of the driving transistor with the data voltage, and the pixels arranged on the first pixel line to the nth pixel line are sequentially supplied with the scan signal, where n is a natural number.

4. The organic light-emitting display of claim 3, wherein the second transistor is turned on in synchronization with the first transistor during the programming period.

5. The organic light-emitting display of claim 1, wherein the one frame comprises the period of time from a first horizontal period corresponding to the programming period of the pixels arranged on the first pixel line to an nth horizontal period corresponding to the programming period of the pixels arranged on the nth pixel line, and the third transistor of each of the pixels arranged on the first pixel line is turned on for a kth horizontal period, and the third transistor of each of the pixels arranged on the second pixel line is turned on for a k+1th horizontal period, where k is a natural number greater than 2 and less than or equal to n.

6. The organic light-emitting display of claim 5, wherein as the average value of data voltages of pixels arranged on each pixel line among the first pixel line to the nth pixel line is lowered, the value of k is lowered.

7. A driving method of an organic light-emitting display comprising pixels arranged on a first pixel line to an nth pixel line, where n is a natural number, the method comprising:

sequentially programming a data voltage for the pixels arranged on the first pixel line to the nth pixel line according to a scan signal;

sequentially causing the programmed pixels to emit light; and sequentially writing black data to the pixels arranged on the first pixel line to the nth pixel line in response to a black data control signal, wherein the black data control signal is sequentially applied to the first pixel line to the nth pixel lines later than the scan signal, and wherein an interval between the scan signal and the black data control signal is the same in all pixel lines among the first pixel line to the nth pixel line.

8. The driving method of claim 7, wherein the sequentially programming of the data voltage comprises:

charging a gate electrode of a driving transistor of each pixel with a data voltage and applying a reference voltage to a source electrode of the driving transistor, wherein the reference voltage is lower than an operating voltage of an organic light-emitting diode.

9. The driving method of claim 8, wherein the sequentially writing of the black data to the pixels arranged on the first pixel line to the nth pixel line comprises:

applying the reference voltage to the gate electrode and source electrode of the driving transistor of the pixels.

10. The driving method of claim 7, wherein, in the sequentially writing of the black data to the pixels arranged on the first pixel line to the nth pixel line, as an average value of video data of each pixel line among the first pixel line to the nth pixel line is lowered, the interval between the scan signal and the black data control signal is narrow.

11. The driving method of claim 7, wherein the sequentially writing black data to the pixels arranged on the first pixel line to the nth pixel line comprises:

writing the black data to the pixels arranged on the first pixel line, in a period synchronized with the programming of the pixels arranged on a kth pixel line, and writing the black data to the pixels arranged on the second pixel line, in a period synchronized with the programming of the pixels arranged on a k+1th pixel line, and wherein k is a natural number greater than 2 and less than or equal to n.

12. The driving method of claim 11, wherein as the average value of data voltages of pixels arranged on each pixel line among the first pixel line to the nth pixel line is lowered, the value of k is lowered.

* * * * *